US006343996B1

(12) United States Patent
Gasseling

(10) Patent No.: US 6,343,996 B1
(45) Date of Patent: Feb. 5, 2002

(54) GOLF GAME PRACTICE DEVICE

(76) Inventor: Donald M. Gasseling, 1480 Evans Rd., Wapato, WA (US) 98951

( * ) Notice: Subject to any disclaimer, the term of this patent is extended or adjusted under 35 U.S.C. 154(b) by 22 days.

(21) Appl. No.: 09/583,207

(22) Filed: May 30, 2000

(51) Int. Cl.[7] ..... A63B 69/36
(52) U.S. Cl. ..... 473/147; 473/142
(58) Field of Search ..... 473/138, 139, 473/142, 147

(56) References Cited

U.S. PATENT DOCUMENTS

| | | | | | |
|---|---|---|---|---|---|
| 1,014,233 | A | | 1/1912 | Kip | |
| 1,326,976 | A | | 1/1920 | Schnurr | |
| 1,504,752 | A | | 8/1924 | Green | |
| 1,527,716 | A | | 2/1925 | Tippen et al. | |
| 1,528,909 | A | | 3/1925 | Bullard | |
| 1,541,420 | A | | 6/1925 | Lambert | |
| 1,700,224 | A | | 1/1929 | Hendersen | |
| 2,051,751 | A | * | 8/1936 | Simon | 473/142 X |
| 2,432,714 | A | | 12/1947 | Bedard | |
| 2,514,093 | A | | 7/1950 | Royston | |
| 3,070,068 | A | | 12/1962 | Chapman | |
| 3,168,312 | A | * | 2/1965 | Davis | 473/142 X |
| 3,502,337 | A | | 3/1970 | Butkus | |
| 3,521,887 | A | | 7/1970 | Butkus | |
| 4,092,027 | A | | 5/1978 | Carter | |
| 4,095,798 | A | | 6/1978 | Marple | |
| 4,139,197 | A | * | 2/1979 | Windall | 473/142 |
| 4,240,592 | A | * | 12/1980 | Russo | 473/142 X |
| 4,660,835 | A | | 4/1987 | Locurto | |
| 4,662,639 | A | | 5/1987 | Bonotto | |
| 4,733,868 | A | * | 3/1988 | Seiden | 473/138 |
| 4,927,154 | A | * | 5/1990 | Boyer et al. | 473/142 |
| 5,054,786 | A | | 10/1991 | Solomon | |
| 5,108,107 | A | | 4/1992 | Shelton | |
| 5,116,059 | A | | 5/1992 | Pelletier | |
| 5,431,404 | A | * | 7/1995 | Kotecki | 473/142 X |
| 5,462,298 | A | * | 10/1995 | Bodine | 280/47.34 |
| 5,542,661 | A | | 8/1996 | Gregan | |
| 5,544,886 | A | | 8/1996 | VanSkiver | |
| 5,700,202 | A | * | 12/1997 | Tucker | 473/142 |
| 5,853,334 | A | * | 12/1998 | Winebrenner | 473/142 |
| 5,989,129 | A | | 11/1999 | O'Neill | |

FOREIGN PATENT DOCUMENTS

| | | | | |
|---|---|---|---|---|
| FR | 2693658 | * | 1/1994 | 273/200 R |
| GB | 2107592 | * | 5/1983 | 273/184 B |

* cited by examiner

*Primary Examiner*—Raleigh W. Chiu
(74) *Attorney, Agent, or Firm*—Stratton Ballew PLLC

(57) ABSTRACT

The invention provides a practice device for practicing the game of golf. The practice device includes a ball, and a tether affixed to the ball for limiting the travel of the ball. The practice device also includes a reel for receiving the tether. The reel can include a lock for preventing the rotational movement of the reel. An anchor is provided for securing the practice device to a surface. The anchor has at least one leg. In an embodiment, the anchor includes two legs, each leg having a distal end and a proximal end. The proximal ends of the legs are joined by a substantially perpendicular cross member, and the distal ends of the legs are receivable into the surface. The reel is rotatably secured to the anchor. The invention can also include a loop secured to the anchor for guiding the tether. The invention can additionally include deflector for preventing the ball from hitting the reel or the anchor.

9 Claims, 5 Drawing Sheets

GOLF GAME PRACTICE DEVICE

TECHNICAL FIELD

The invention relates to the field of sports equipment. More specifically, the invention relates to a practice device for the game of golf.

BACKGROUND OF THE INVENTION

The game of golf has become increasingly popular in recent years. More people are playing the game, and as a result, methods and devices for improving a player's skill in the game have become more desirable.

To practice the game of golf, a player typically pays to hit practice balls at a driving range at a public or private golf course. Alternatively, the player may use a golf game practice device which allows the hitting of a golf ball, while limiting the distance the golfball will travel. The use of a practice device is often desirable because a player can use the device at any desired location as time permits, eliminating the need to travel and to pay fees to a commercial driving range.

As early as 1912, attempts were made to provide practice devices for the golf enthusiast, as evidenced by U.S. Pat. No. 1,014,122 to Kip. Kip discloses a golf ball that is securable to a tether for use in practice play. Several other U.S. patents also disclose practice devices. The devices generally include a base, a tether secured to the base, and a ball secured to the tether. Examples include U.S. Pat. No. 1,504,752 to Green, U.S. Pat. No. 1,528,909 to Bullard, and U.S. Pat. No. 1,700,224 to Hendersen.

In U.S. Pat. No. 3,502,337, inventor Butkus discloses a practice device of the type described above. As an improvement, the Butkus '337 device includes an elasticized tether. In U.S. Pat. No. 3,521,887, Butkus further discloses a tether of variable length. U.S. Pat. No. 5,054,786 to Solomon provides a practice device in which the tether includes both elastic and non-elastic segments. The length of the elastic segment can be adjusted to vary the distance the ball travels.

While the above patents describe golf game practice devices which are functional, a need exists for a new golf game practice device that solves several problems not addressed by the known devices. For example, while some of the known devices provide a tether of variable length, the amount of variability is limited. Furthermore, in those devices where a relatively long tether is provided, storage of the device is problematic, because the tether can easily become tangled. Conversely, if a relatively short tether is provided, the player is limited as to the types of shots he can practice. A short tether does not allow the ball to travel its full trajectory on long drives, so the player can not see how adjustments to his stance and swing ultimately affect the distance and course of the ball.

SUMMARY OF INVENTION

A golf game practice device is disclosed. The golf game practice device includes a ball, and a tether affixed to the ball for limiting the travel of the ball. The practice device also includes a reel for receiving the tether. An anchor is provided for securing the practice device to a surface. The anchor has at least one leg, and the leg has a distal end and a proximal end. The distal end of the leg is receivable into the surface. The reel is rotatably secured to the anchor.

In an embodiment of the invention, the anchor includes two legs, each leg having a distal end and a proximal end.

The proximal ends of the legs are joined by a substantially perpendicular cross member, and the distal ends of the legs are receivable into the surface. The reel is rotatably secured to the anchor.

In an embodiment, the invention further includes a loop secured to the anchor for guiding the tether.

In an additional embodiment, the invention includes a handle on the reel for rotating the reel.

In a further embodiment of the invention, the reel includes a lock for preventing rotational movement of the reel.

In another embodiment of the invention, a deflector is provided for preventing the ball from hitting the reel or the anchor.

According to the invention, a golf game practice device having a tether of variable length is provided. The features and advantages of the invention will be made clear by the description and drawings that follow.

DETAILED DESCRIPTION OF SPECIFIC EMBODIMENTS

Figure 3:
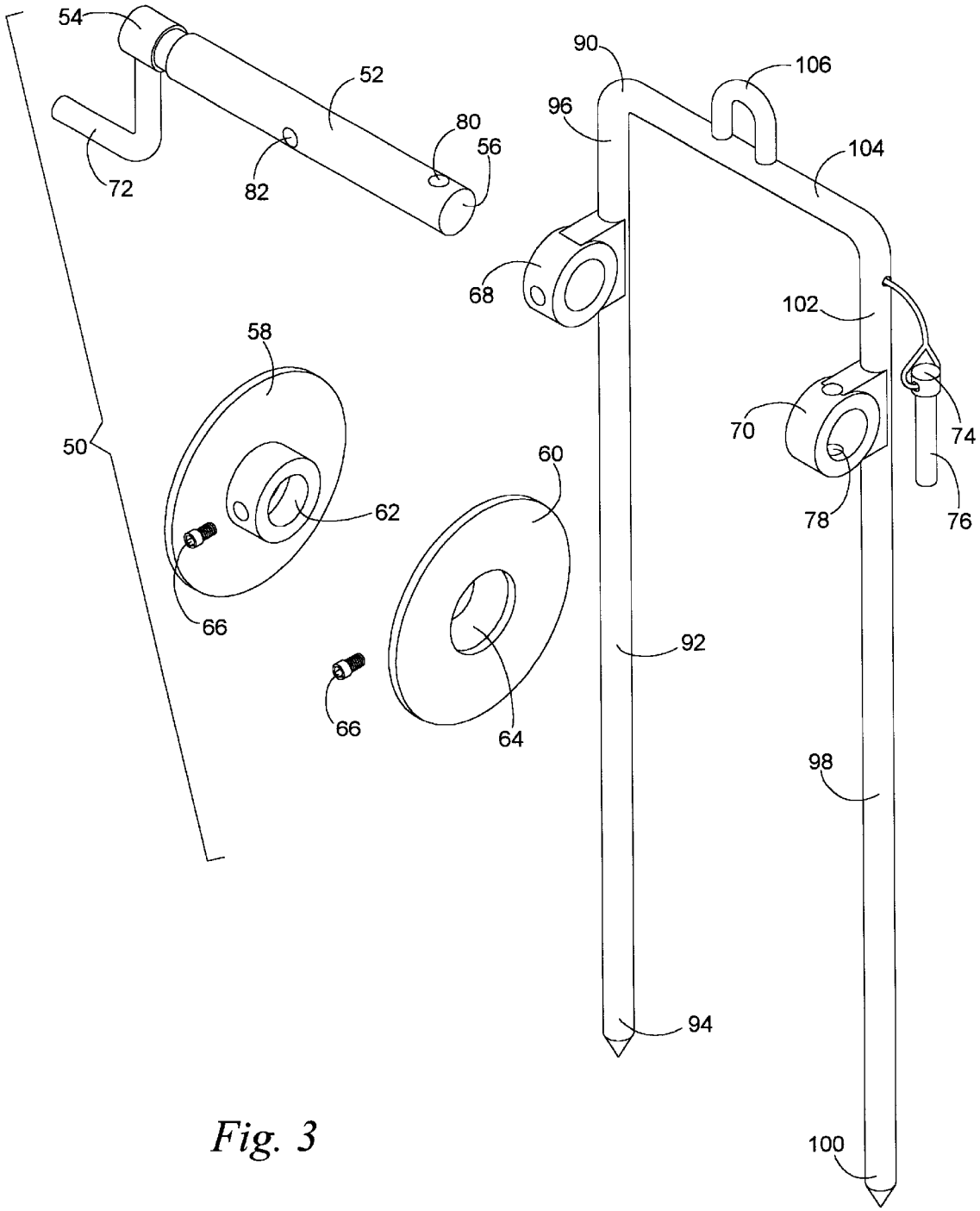
FIG. 3 is an exploded partial perspective view of the golf game practice device of the present invention.
Figure 4:
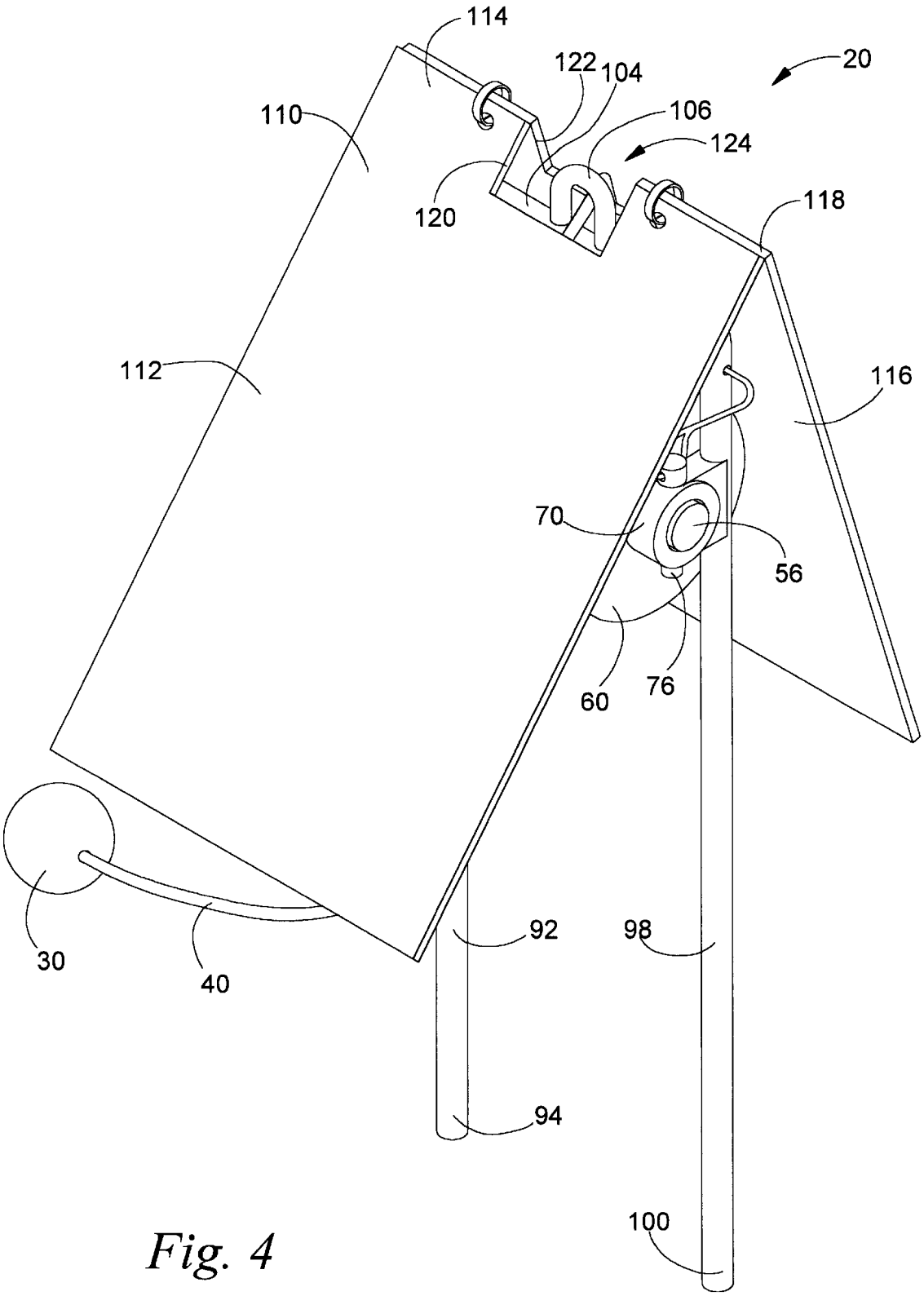
FIG. 4 is a perspective view of an embodiment of the golf game practice device of the present invention.
Figure 5:
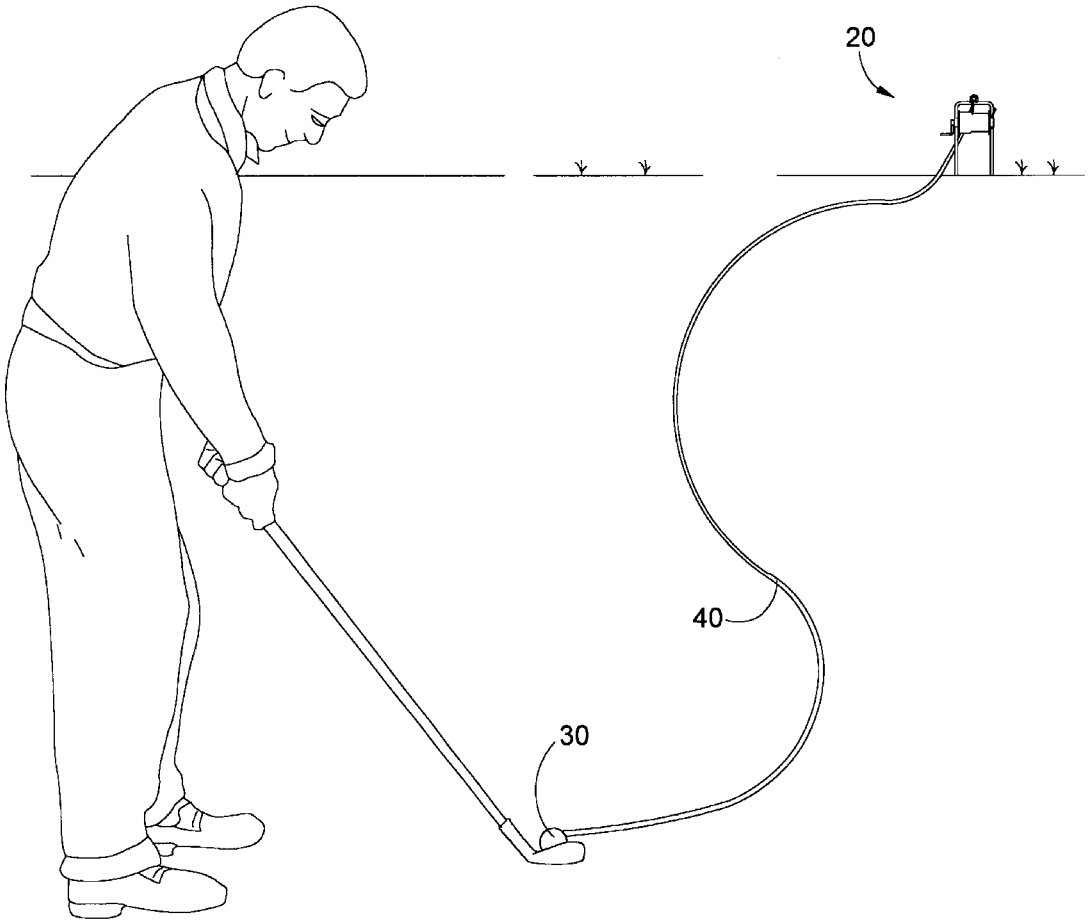
FIG. 5 is a perspective view of a player using the golf game practice device of the present invention.

The invention comprises a golf game practice device 20, referred to hereinafter as simply the "practice device," as shown in FIGS. 1 through 5. The practice device includes a ball 30, a tether 40, a reel 50, and an anchor 90. In an embodiment, the practice device also includes a deflector 110 as shown in FIG. 4.

Figure 1:
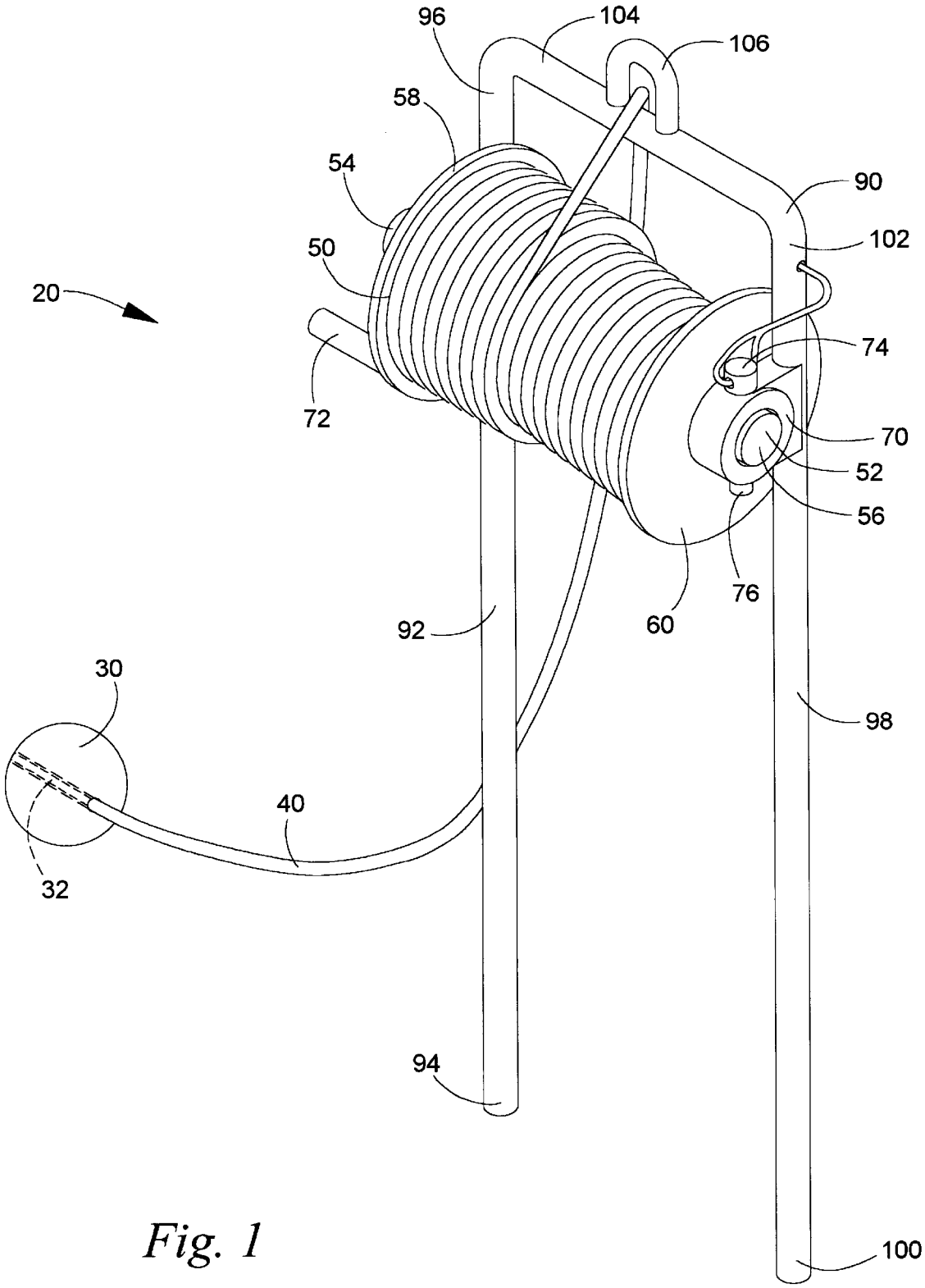
FIG. 1 is a perspective view of the golf game practice device of the present invention.
Figure 2:
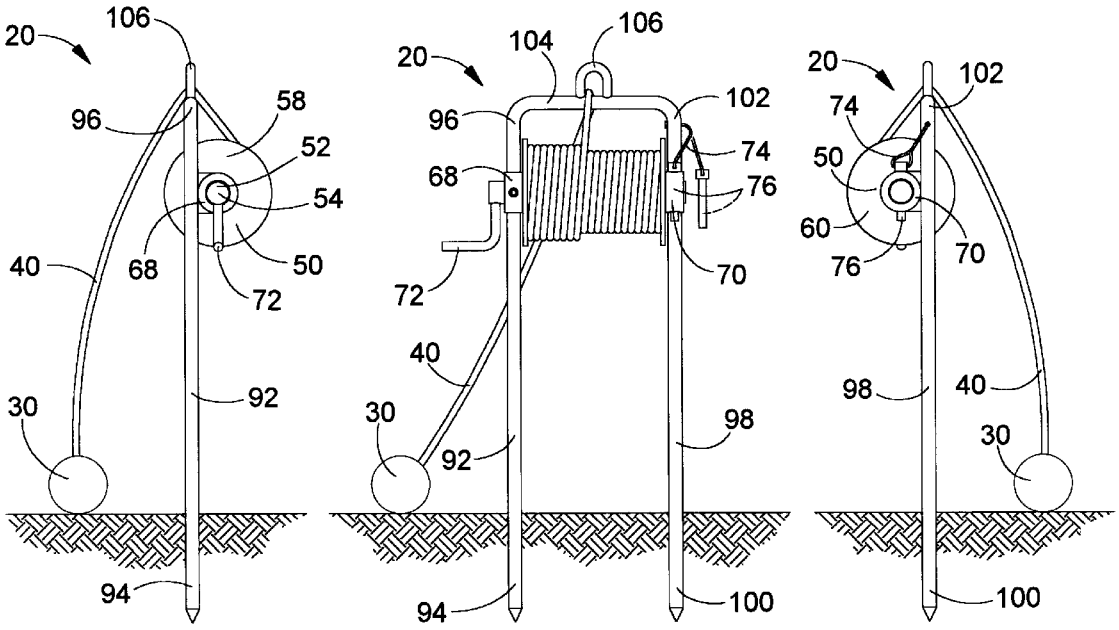
FIG. 2*a* is an end view of the golf game practice device of the present invention.
FIG. 2*b* is a side view of the golf game practice device of the present invention.
FIG. 2*c* is an end view of the golf game practice device of the present invention.

The ball 30 of the practice device is preferably a conventional golfball that has been adapted to be secured on the tether 40. Various methods of securing the ball to the tether are known. In one preferred method a bore 32 is provided through the center of the ball, and the tether is passed through the bore, as shown in FIG. 1. A retaining device such as a knot, washer, plug or other device is employed to retain the ball on the tether. Other methods of securing the ball to the tether may also be used, and are considered to be within the scope of the invention.

The tether 40 of the practice device is preferably a length of high tensile strength cord. Most preferably, the tether is a length of parachute cord. The inventor has had success with 550 pound test parachute cord, although other weights and types of cords would be suitable, providing that the cord will not break when the ball 30 is hit.

The reel 50 of the practice device 20 is secured to the anchor 90. The reel serves several purposes. The reel provides a convenient way to store the tether 40. When the tether is wound on the reel it will not become tangled or knotted, and will be readily available for use. The reel also provides a way to adjust the length of the tether. This is a valuable feature, because it allows the user to limit the distance the ball will travel when hit. The user can use the device in a confined area, such as a backyard or park, without fear of damaging nearby buildings, vehicles, etc. Additionally, the reel allows the user to accurately simulate long drives. For example, by paying out 75 feet of tether from the reel, the user can practice drives as long as 150 feet. The travel of the ball 30 will not be stopped short by the tether, so the user can observe the trajectory and hook or slice of the ball, as is possible at a commercial driving range.

Another purpose of the reel 50 is to provide a tidy and convenient way of bringing in the ball 30 after it is hit. Usually, the user will walk to the place where the ball landed, and hit the ball again from that location. At the conclusion of a practice session, however, the reel provides a convenient mechanism for bringing in the ball while neatly stowing the tether 40.

In a preferred embodiment of the invention, the reel 50 includes a rotatable spindle 52 having a first end 54, a second end 56, a first end rim 58 and a second end rim 60, as shown in FIG. 3. A first spindle receiving aperture 62 in the first end rim and a second spindle receiving aperture 64 in the second end rim are sized to receive the spindle first and second ends, respectively. Set screws 66 secure the first end rim and the second end rim to spindle. When the set screws are secure, they prevent lateral movement of the spindle. Other devices for holding the spindle in position are also contemplated, and considered to be within the scope of the invention. A first spindle mount 68 and a second spindle mount 70 are secured to the anchor 90. The first end of the spindle is rotatably received in the first spindle mount, and the second end of the spindle is rotatably received in the second spindle mount. Preferably, the reel 50 also includes a handle 72 for turning the reel, as detailed in FIGS. 2*a* and 2*b*. The handle is preferably secured to the first end of the spindle.

In an embodiment, the reel 50 also includes a lock 74. When engaged, the lock stops the rotary motion of the reel. The user can pay out a desired amount of tether 40, lock the reel, and thus limit the distance the ball 30 will travel when hit. The lock can also be employed when the tether has been wound on the reel for storage, to prevent the tether from unwinding. There are various known means of locking a reel to prevent it from rotating. In the embodiment shown in the drawings and detailed in FIG. 3, the lock includes a pin 76, a mount pin receiving aperture 78 and a spindle pin receiving aperture 80. When the anchor pin receiving aperture and the spindle pin receiving aperture are aligned, the pin can be inserted therethrough to prevent the reel from rotating. Other reel locking means may also be employed, and are considered within the scope of the invention.

Preferably, the spindle 52 further includes an aperture 82 for receiving an end of the tether 40. The end of the tether is passed through the aperture and knotted to secure the tether to the spindle. Any method of securing the tether to the spindle can be used as an alternative to the aperture 82.

It will be appreciated that there are various known reel-type devices which would fulfill the requirements of the practice device 20 described herein. Furthermore, various mounting configurations can be used to secure the reel in position, including configurations which secure the reel in a position other than the horizontal orientation shown in the drawings and described herein. Therefore, the reel 50 may be any device which can take up and pay out the tether 40 as required by the invention.

The anchor 90 of the practice device 20 is shown in FIGS. 1 through 5. The anchor provides an attachment point for the reel 50 and also secures the practice device to a surface. In most instances, the surface will be a ground surface such as soil, dirt, sod, gravel, sand, or a combination thereof The anchor includes at least one leg, and preferably includes at least two legs spaced apart from and parallel to one another. In a preferred embodiment, and as shown in the drawings, the anchor includes a first leg 92. The first leg has a distal end 94 and a proximal end 96. The anchor further includes a second leg 98. The second leg has a distal end 100 and a proximal end 102. A substantially perpendicular cross member 104 joins the first leg to the second leg. Preferably, the cross member is affixed to the proximal ends of the first leg and the second leg. The first leg, the second leg, and the cross member preferably form a single contiguous unit. The distal end of each leg can have a chiseled or sharpened tip to facilitate pushing the anchor into the ground.

The first spindle mount 68 and the second spindle mount 70 are secured to the anchor 90 at the first leg 92 and the second leg 98, respectively. In a preferred embodiment, the first spindle mount and the second spindle mount are positioned near the proximal ends 96, 102 of the first and second legs, respectively.

In an embodiment, the anchor 90 also includes a loop 106 for guiding the tether 40 as it is wound or unwound on the reel 50. Preferably, the loop is positioned at the approximate center of the cross member 104. The loop has a smaller diameter than the ball 30, so the ball and attached tether cannot be pulled through the loop. The loop thus provides a stop against which the ball rests when the tether is fully wound on the reel. The tether is secured to the ball, and cannot unwind from the reel when the lock 74 is engaged.

In an additional embodiment of the invention, a deflector 110 is provided, as shown in FIG. 4. The deflector can be placed over the practice device 20 when in use, to prevent the ball 30 from hitting the practice device and bouncing back, potentially injuring the user. The deflector comprises a substantially rigid first panel 112 having a first panel upper edge 114, and a substantially rigid second panel 116 having a second panel upper edge 118.

The first panel 112 and the second panel 116 are hingedly joined together at their respective upper edges 114 and 118, as shown in FIG. 4. The upper edge of the first panel includes a first panel notch 120, and the upper edge of the second panel includes a second panel notch 122. The first panel notch and the second panel notch are substantially aligned. Most preferably, the opening 124 created by the first panel notch and the second panel notch is sized to allow the passage of the ball 30 therethrough. The deflector is preferably made from a low friction, impact resistant material that is also weather proof and lightweight. Ultra high molecular weight (UHMU) plastic has been used successfully for the deflector material.

In use, the practice device 20 provides a simple yet very effective method of practicing the game of golf. The user secures the practice device to a surface such as the ground, as discussed above, by pushing the legs 92 and 98 of the anchor 90 into the ground. The lock 74 is disengaged to allow the reel 50 to rotate. The tether 40 is then unwound from the reel to a desired length, and the lock engaged to stop the rotation of the reel. The practice device is ready for use.

The user of the practice device 20 can unwind the tether 40 to a length appropriate for long drives. For example, the tether can be unwound to 50 feet, so that the ball 30 is 50 feet away from the anchor 90. The user can then hit the ball using a golf club, and the ball will travel as far as 100 feet. The user can observe the trajectory of the ball, and make adjustments to stance and swing the next time the ball is hit.

Alternatively, the user of the practice device 20 can unwind the tether 40 to a limited length, as determined by obstacles in the area. For example, if the practice device is being used in a residential area, the user may limit the length of the tether to avoid reaching buildings, vehicles, neighboring property, and the like. The user can then hit the ball using a golf club, without fear of damaging the nearby buildings or vehicles, or sending the ball onto neighboring property.

When the user has concluded a practice session using the practice device 20, the lock 74 on the reel is disengaged, and the tether is 40 wound back on the reel by using the handle 72 to rotate the reel. When the tether is completely wound, the ball 30 attached to the tether will abut the loop 106 and prevent the reel from being rotated any further. The lock 76 is then engaged to prevent the reel from rotating in either direction. The reel is thus secured, and the practice device 20 is neatly stored until the next use.

The method of using the invention can further include the step of positioning the deflector 110 in a tent-like manner over the practice device 20 after the practice device has been secured in the ground or other surface. The ball 30 and tether 40 are passed through the opening 124 of the deflector before extending the tether to its desired length. In the event that the ball is inadvertently directed at the anchor 90 or reel 50, the deflector provides a surface off of which the ball can be deflected. The smooth sloped surface provided by the first panel 112 and the second panel 116 will cause the ball to bounce slightly, but continue in the general direction in which the ball was hit.

In compliance with the statutes, the invention has been described in language more or less specific as to structural features and process steps. While this invention can be embodied in different forms, the specification describes and illustrates preferred embodiments of the invention. It will be understood that this disclosure is an exemplification of the principles of the invention, and is not intended to limit the invention to the particular embodiments described. Those with ordinary skill in the art will appreciate that other embodiments and variations of the invention, which employ the same inventive concepts as the invention, are possible. Therefore, the invention is not to be limited except by the following claims, as appropriately interpreted in accordance with the doctrine of equivalents.

What is claimed is:

1. A golf game practice device, the practice device including:

a ball;

a tether affixed to the ball for limiting the travel of the ball;

a reel for receiving the tether; and an anchor for securing the practice device to a surface, the anchor including a first leg and a second leg, each leg having a distal end and a proximal end, the distal ends receivable into the surface, and the proximal ends joined by a cross member; and the reel rotatably secured to the anchor.

2. The practice device of claim 1, further including a loop secured to the anchor for guiding the tether.

3. The practice device of claim 1, the reel further including a handle for rotating the reel.

4. The practice device of claim 1, the reel further including a lock for preventing rotative movement of the reel.

5. The practice device of claim 1, further including a deflector for preventing the ball from hitting the reel or the anchor.

6. The practice device of claim 1, the reel including:

a spindle, the spindle having a first end a second end;

a first rim secured proximate the first end of the spindle, the first rim having a first spindle receiving aperture;

a second rim secured proximate the second end of the spindle, the second rim having a second spindle receiving aperture;

a first spindle mount affixed to the anchor for receiving the first end of the spindle; and a second spindle mount affixed to the anchor for receiving the second end of the spindle.

7. A golf game practice device, the practice device including:

an anchor, the anchor having a first leg, a substantially parallel second leg, and a substantially perpendicular cross member joining the first leg to the second leg;

a ball;

a tether affixed to the ball for limiting the travel of the ball; and a reel for receiving the tether, the reel including a spindle, the spindle having a first end a second end; a first rim secured proximate the first end of the spindle, the first rim having a first spindle receiving aperture;

a second rim secured proximate the second end of the spindle, the second rim having a second spindle receiving aperture; a first spindle mount affixed to the first leg of the anchor for receiving the first end of the spindle; and a second spindle mount affixed to the second leg of the anchor for receiving the second end of the spindle.

8. The golf game practice device of claim 7, further including a lock for preventing rotational movement of the reel.

9. The golf game practice device of claim 8, in which the lock comprises a pin, a mount pin receiving aperture formed in the second spindle mount, and a spindle pin receiving aperture formed in the second end of the spindle, such that the mount pin receiving aperture and the spindle pin receiving aperture are alignable, and the pin is receivable in the mount pin receiving aperture and the spindle pin receiving aperture to prevent rotational movement of the reel.

* * * * *